US005630853A

United States Patent [19]

Eales

[11] Patent Number: 5,630,853

[45] Date of Patent: May 20, 1997

[54] COAL SLAGGING GASIFIER

[75] Inventor: David F. Eales, Dorridge, England

[73] Assignee: British Gas PLC, London, England

[21] Appl. No.: 443,316

[22] Filed: May 17, 1995

[30] Foreign Application Priority Data

Jun. 9, 1994 [GB] United Kingdom ..... 9411600

[51] Int. Cl.[6] ..... B01J 3/00

[52] U.S. Cl. ..... 48/62 R; 48/63; 48/76; 48/77; 48/DIG. 2; 110/165 R; 110/171; 266/236

[58] Field of Search ..... 48/62 R, 63, 64, 48/77, 87, DIG. 2, 76; 266/236, 271; 110/165 R, 171

[56] References Cited

U.S. PATENT DOCUMENTS

| | | | |
|---|---|---|---|
| 4,071,329 | 1/1978 | Eales . | |
| 4,073,627 | 2/1978 | Anderson | 48/DIG. 2 |
| 4,078,903 | 3/1978 | Eales . | |
| 4,119,411 | 10/1978 | Anderson et al. | 48/62 R |
| 4,126,427 | 11/1978 | Eales . | |
| 4,129,422 | 12/1978 | Wood | 48/DIG. 2 |
| 4,177,042 | 12/1979 | Wood | 48/DIG. 2 |
| 4,192,654 | 3/1980 | Brooks | 266/236 |
| 4,195,978 | 4/1980 | Anderson | 266/238 |
| 4,331,450 | 5/1982 | Elliott | 48/DIG. 2 |
| 4,487,612 | 12/1984 | Hebden et al. | 48/DIG. 2 |
| 4,828,578 | 5/1989 | Bleyker | 48/DIG. 2 |
| 4,992,081 | 2/1991 | Bleyker | 48/DIG. 2 |

FOREIGN PATENT DOCUMENTS

| | | | |
|---|---|---|---|
| 0078100 | 4/1983 | European Pat. Off. . | |
| 1098552 | 1/1968 | United Kingdom | 48/DIG. 2 |
| 1508671 | 4/1978 | United Kingdom . | |
| 1512677 | 6/1978 | United Kingdom . | |
| 1570286 | 6/1980 | United Kingdom . | |
| 1571107 | 7/1980 | United Kingdom . | |
| 2233341 | 1/1991 | United Kingdom . | |
| WO82/01374 | 4/1982 | WIPO . | |

*Primary Examiner*—Robert J. Warden
*Assistant Examiner*—Hien Tran
*Attorney, Agent, or Firm*—Larson & Taylor

[57] ABSTRACT

A coal slagging gasifier has a gasifying vessel over a quenching chamber partly filled with water below the surface of which a wall of a cylindrical, metal shield dips. The gasifying vessel has a hearth including a slag tap having a slag outlet with a lowermost opening at substantially the same horizontal level as an annular burner and a ring-shaped nozzle. The burner which surrounds the outlet is spaced therefrom and inset into a recess surrounding the outlet, and the nozzle surrounds the burner. Outlet ports from the nozzle project through a ceiling of the shield to direct a flow of combustion sustaining gas vertically downwards into the quenching chamber from the outlet ports and towards the water. An opening in the centre of the shield ceiling exposes the interior of the shield to the burner and the slag tap outlet. The burner separately supplies fuel gas and combustion air.

15 Claims, 1 Drawing Sheet

COAL SLAGGING GASIFIER

BACKGROUND OF THE INVENTION

This invention concerns a coal slagging gasifier and more particularly to a quenching chamber arrangement thereof.

The coal slagging gasifier concerned is of the type (hereinafter call the type referred to) comprising a column-like gasifying vessel into which coal or other carbonaceous fuel is introduced into the top of the gasifying vessel and is gasified under high pressure and temperature by means of oxygen and steam introduced into the fuel in the gasifying vessel through tuyeres, and wherein residual ash collects as molten slag and iron in a hearth of the gasifying vessel from which said molten slag and iron are periodically discharged (commonly called 'slag-tapping') through a slag tap outlet in the hearth into water contained in a quenching chamber below the hearth, the pool of molten slag and iron being maintained in the hearth by hot combustion products passing up the slag tap outlet from burner means in or adjacent to the quench chamber to retain the slag and iron in the hearth, and tapping of the molten slag and iron being promoted by reducing pressure in the quenching chamber by controlled venting to atmosphere through a venting system so as to produce a differential pressure between the quenching chamber and the gasifying vessel.

A gasifier of the aforesaid type is disclosed in British Patent No. 1,512,677 in which the top end of the quenching chamber is formed by a relatively narrow neck, and the slag tap outlet has a lower end of bell-mouth shape opening into said neck. The aforesaid burner means is disposed around the wall of the bell-mouth, and a ring of nozzles emitting upwardly combustion sustaining gas is disposed in the quenching chamber just above the water level so that the combustion sustaining gas flows upwardly (towards the slag tap outlet) alongside the inner surface of the neck to help keep the latter cool. It has been found that fouling of the slag tap outlet and the burner means can occur. This appears to be due to excessive dribbling of slag and iron through the slag tap outlet between taps. These dribbles are broken into small fragments by the violent turbulence created in the quenching chamber by interaction between the flows of products of combustion from the burner means and the combustion sustaining gas from the ring of nozzles. These fragments are transported in the flows and deposited on various surfaces within the quenching chamber, for example the ring of nozzles and the burner means.

An object of the invention is to provide a gasifier of the type referred to capable of being constructed to avoid or reduce the chance of said fragments being deposited inconveniently.

SUMMARY OF THE INVENTION

According to the invention there is provided a coal slagging gasifier of the type referred to comprising said slag tap outlet having a lowermost end providing an opening into said quenching chamber, nozzle means surrounding a generally vertical axis of said slag tap outlet, and said nozzle means being disposed substantially at or adjacent to the same horizontal level as said opening and arranged to direct downwardly towards the water level in the quenching chamber a substantially annular curtain of combustion sustaining gas.

The nozzle means may be arranged to direct said curtain of combustion sustaining gas substantially vertically downwards.

The nozzle means may comprise a tubular passage substantially in the form of a ring substantially centred on said axis and having a plurality of ports at an underside of said passage for said combustion sustaining gas to emerge into the quenching chamber through said ports.

The quenching chamber may comprise a substantially vertical cylindrical wall substantially co-axial with said axis of the slag tap outlet.

The ports of said nozzle means may each have a centre disposed on substantially the same circle substantially centred on said axis, and said circle has diameter which is less than the internal diameter of the cylindrical wall and greater than one half of said internal diameter.

Said cylindrical wall may be provided at or adjacent to its upper end with a transverse top wall having openings which allow the combustion sustaining gas to be directed into the quenching chamber within the cylindrical wall.

The cylindrical wall may be a shield, the quenching chamber may have another wall surrounding the shield, and pipework may be disposed between the shield and said other wall.

The combustion sustaining gas may be oxygen, air, or nitrogen, or a mixture comprising oxygen and at least one member of the group consisting of carbon dioxide and nitrogen.

Another object is to provide a construction of gasifier according to the invention in which the chance of fouling said burner means by dribbling slag and iron is reduced. To this end the burner means, arranged to introduce at least fluid fuel into the combustion chamber, may be disposed around the axis of the slag tap outlet, and may be spaced radially from said opening.

The burner means may be at substantially the same horizontal level as said opening.

The slag tap outlet may be formed in a structure having a recess in which the burner means is mounted such that a portion of said structure surrounding said opening is surrounded by said burner means.

Said burner means may comprise first and second substantially concentric annular passages each formed with outlet ports in walls of said passages, the outlet ports in a said wall of the first passage being to allow passage of fluid fuel from said first passage to the quenching chamber, and the outlet ports in a said wall of the second passage being to allow passage of combustion sustaining gas from the second passage to the quenching chamber.

At least some of said outlet ports may be inclined downwardly from the respective first or second passage into the quenching chamber and extend along axes which are at acute angles to substantially said vertical axis at points on the vertical axis below said burner means.

BRIEF DESCRIPTION OF THE DRAWINGS

The invention will now be further described by way of example with reference to the accompanying drawings in which.

DETAILED DESCRIPTION OF THE PREFERRED EMBODIMENT

Figure 1:
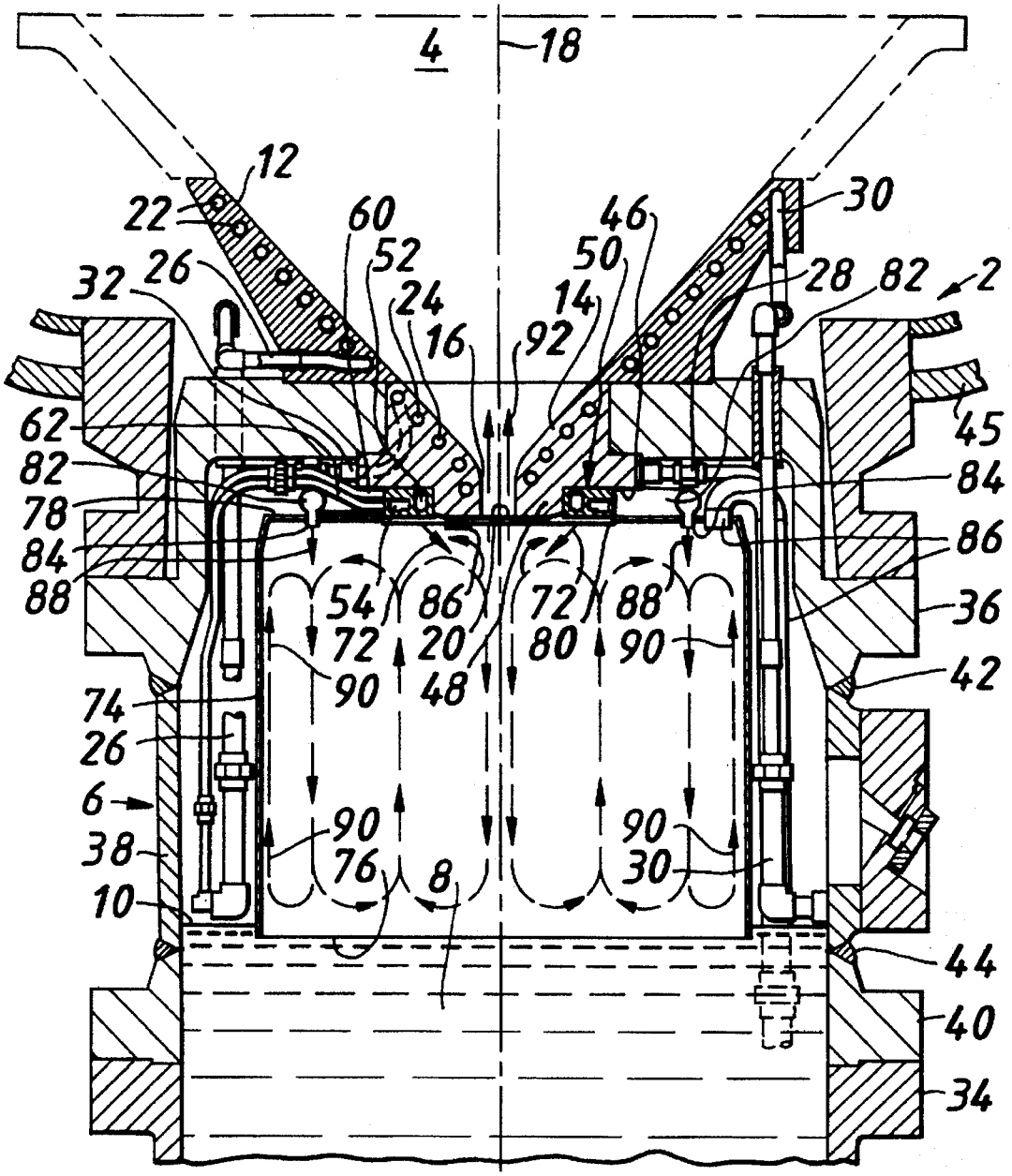
FIG. 1 shows a fragment, in cross-section, of a coal slagging gasifier formed according the invention, the fragment being of a lower end of the gasifying vessel and an upper part of the quenching chamber.

Referring to FIG. 1, a coal slagging gasifier 2 comprises a gasifying vessel 4 over a quenching chamber 6 containing a reservoir of water 8 having a surface or water level 10. In known manner the gasifying vessel 4 is pressurised and refractory-lined (not shown). Coal is fed into the top (not shown) of the gasifying vessel 4, and oxygen and steam are introduced into the vessel near the lower end thereof through known tuyeres (not shown) to promote gasification of the coal. At its lower end, the gasification vessel 4 has a sloping hearth comprising an annular hearth member 12 and a slag tap 14 having a substantially vertical bore of circular cross-section forming a slag tap outlet 16 having a substantially vertical axis 18 and an opening 20 at the lowermost end of the slag tap outlet. The hearth member 12 and the slag tap 14 have respective sets of channels 22 and 24 to which cooling water is supplied via pipe 26 or 28 and from which the water leaves via outlet pipe 30 or 32.

In use of the gasifier, a pool of molten slag collects in the hearth 12, and the slag tap 14 and is periodically passed through the slag tap outlet 16 into the water 8 where it is quenched before being transferred to a lock hopper (not shown) in the form of a dense small grained frit.

The quenching chamber 6 comprises of a lower quench vessel 34 and a generally cylindrical distance piece or sandwich flange comprising top, intermediate and bottom parts 36, 38 and 40 respectively, welded together at 42 and 44. The sandwich flange 36, 38, 40 secures the quench vessel 34 to both the hearth 12, and the slag tap 14 and an outer wall 45 of the gasifying vessel 4.

At its underside the slag tap 14 has a recess 46 leaving a depending central annular spigot part 48 surrounding the opening 20. An annular burner 50 mounted in the recess 46 surrounds the spigot part 48 and has an axis substantially coincident with axis 18. The burner 50 is radially spaced by the spigot 48 from the slag tap outlet opening 20 and is at substantially the same horizontal level as said outlet opening 20.

Figure 2:
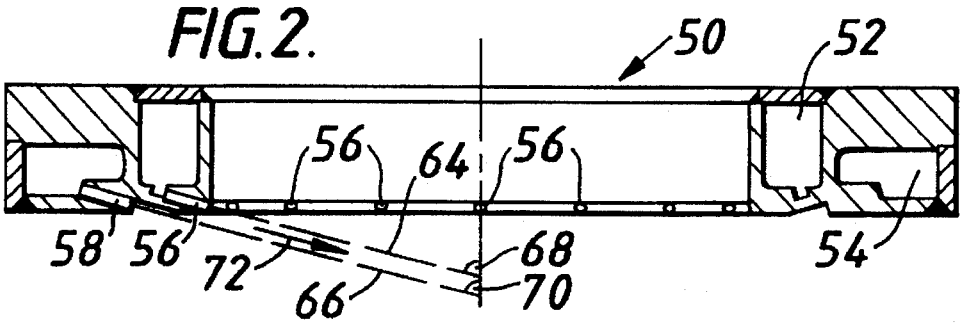
FIG. 2 is a cross-section of the burner means in FIG. 1, but shown on a scale larger than in FIG. 1.

With reference to FIG. 2, it will be seen that burner 50 comprises two concentric annular passages 52 and 54 through the undersides of which extend through outlet passages or ports 56 and 58 respectively. Fuel gas is supplied to the passage 52 and issues through the ports 56 to burn in the quenching chamber 6. The ports 56 are substantially equally spaced around the burner. Directly behind each port 56 is a corresponding said port 58. Combustion sustaining gas, for example air, is supplied to the passage 54 and issues through the ports 58 to support combustion of the fuel gas. Fuel gas and the combustion sustaining gas are supplied to the burner passages 52 and 54 through supply pipes 60 and 62 respectively (see FIG. 1). The ports 56 and 58 are generally radially directed with respect to the axis 18. Each port 56 and 58 has an axis 64 or 66 which is at an angle of substantially 15° to the horizontal and thus subtends an acute angle 68 or 70 with the axis 18. Each angle 68 and 80 can be substantially 75°. Accordingly combustion gases emerging from the burner 50 into the quenching chamber 6 do so along the direction of arrows 72 (see FIGS. 1 and 2), which direction has both an horizontal and a vertical component.

Returning to FIG. 1, a metal shield 74 is mounted in the quenching chamber 6. The shield 74 has a hollow substantially cylindrical shape which is substantially vertical and its axis is axis 18. A bottom end 76 of the shield 74 is submerged in the water 8. At its top end the shield has an annular transverse wall or ceiling 78 of annular shape having a central opening surrounded by a rim 80 of slightly larger diameter than the burner 50 so that the burner and spigot part 48 face into that part of the quenching chamber within the shield 74.

A nozzle 82 is mounted above the shield ceiling 78. The nozzle 82 comprises a tube in the form of a ring or torus substantially centred on the axis 18 and surrounding the burner 50. Nozzle 82 is at substantially the same horizontal level as the slag tap outlet opening 20 and has at its underside a plurality of substantially equally space outlet jets or ports 84 in the form of nipples pointing substantially vertically downwards through corresponding apertures in the shield ceiling 78. The nozzle 82 is supplied (by means not shown) with combustion sustaining gas which it emits into the quenching chamber within the shield 74. This combustion sustaining gas may be supplied initially at substantially the temperature of the ambient atmosphere, and may be air or oxygen, or oxygen mixed with at least one other gas; it may for example be a mixture comprising oxygen and at least me members of the group consisting of, carbon dioxide and nitrogen.

The centres on vertical axes of the ports 84 are all disposed on the same circle substantially centred on the axis 18. That circle has a diameter which is greater than 50% of the internal diameter of the cylindrical shield 74 and can be, for example, substantially 79% of the aforesaid internal diameter. A plurality of vent pipes 86 also extend at their upper ends through corresponding openings in the shield ceiling 78. The vent pipes are connected to a gas venting or extraction system (not shown) including valve means.

As can be seen various items of pipework, such as 26, 28, 30, 32, 60, 62 and 86, are located between the shield 74 and the outer wall or flange 36, 38 of the quenching chamber 6 to shield them from the effects of heat within the region surrounded by the shield.

When the gasifier is operating and slag is not being tapped, the venting system is closed. Products of combustion from burner 50 initially travel in the directions of arrows 72 and combustion sustaining gas is direct downwards curtain like in the direction of arrows 88 from the ports 84 of the nozzle 82 and circulates, at least in part, as indicated by ascending arrows 90, alongside the inner wall of the shield 74 to keep the latter cool. A form of gas circulation which has been observed to take place in the quenching chamber above the water level 10 is indicated by the arrows and broken lines. Due to the pressure in the quenching chamber 6 being higher than that in the gasifying vessel 4, hot products of combustion ascend through the slag tap outlet 16 as indicated by arrows 92. This supplies heat to the slag and iron on the hearth and assists in keeping them molten. When slag tapping is required, the venting system is operated, e.g. by opening the valve means, so that gas from the quenching chamber is exhausted therefrom, for example, to atmosphere. This drops the gas pressure in the quenching chamber 6 to less than that in the gasifying vessel 4. Under this pressure difference the molten slag and iron are tapped by which is meant the molten slag and iron descend through the slag tap outlet 16 into the quenching chamber and thence into the water. To stop slag tapping, the venting operation is stopped, for example, by closing the valve means in the venting system.

During slag tapping the supply of fuel gas to the burner 50 may be reduced or stopped, to save fuel, but need not be.

I claim:

1. In a coal slagging gasifier comprising:

a gasifying vessel; means or introducing carbonaceous fuel into the top of said vessel for gasification thereof in said vessel; means for introducing a gasifying medium comprising oxygen and steam into said vessel; a hearth located at the bottom of said vessel and including a slag tap outlet therein for removing slag therefrom; a burner means positioned to direct combustion products up the slag tap outlet for maintaining a pool of molten slag in the hearth; a quenching chamber containing water located below said gasifying vessel into which molten slag and iron are periodically removed downwardly from said hearth through said slag tap outlet into said quenching chamber; venting means for producing a differential pressure between the quenching chamber and the gasifying vessel to promote tapping of the molten slag and iron, said slag tap outlet having a lowermost end providing an opening into said quenching chamber;

the improvement which comprises a nozzle means connected to a combustion-sustaining gas source, said nozzle means comprising a tube substantially in the form of a ring substantially centered and surrounding said burner means and disposed substantially at or adjacent to the horizontal level of said opening, said tube having a plurality of ports on its underside arranged for directing a substantially annular curtain of combustion-sustaining gas substantially vertically downwards toward the water level in said quenching chamber.

2. A gasifier according to claim 1, wherein the quenching chamber comprises a substantially vertical cylindrical wall substantially co-axial with an axis of the slag tap outlet.

3. A gasifier according to claim 1, wherein the quenching chamber comprises a substantially vertical cylindrical wall substantially co-axial with an axis of the slag tap outlet, said ports each has a center disposed on substantially the same circle substantially centered on said axis, and said circle has a diameter which is less than an internal diameter of said cylindrical wall and greater than one half of said internal diameter.

4. A gasifier according to claim 3, wherein said circle has a diameter which is substantially 79% of said internal diameter of said cylindrical wall.

5. A gasifier according to claim 2, wherein said cylindrical wall is provided at or adjacent to its upper end with a transverse top wall having apertures which allow said combustion sustaining gas to be directed into said quenching chamber within said cylindrical wall.

6. A gasifier according to claim 2, wherein said cylindrical wall is a shield, said quenching chamber has a wall surrounding said shield, and pipework is disposed between said shield and said wall.

7. A gasifier according to claim 1, wherein said combustion sustaining gas comprises oxygen.

8. A gasifier according to claim 1, wherein said combustion sustaining gas is oxygen, air, or a mixture comprising oxygen and at least one member of the group consisting of carbon dioxide and nitrogen.

9. A gasifier according to claim 1, wherein said burner means arranged to introduce at least fluid fuel into the quench chamber is disposed around an axis of said slag tap outlet, and said burner means is spaced radially from said opening.

10. A gasifier according to claim 9, wherein said burner means is at substantially the same horizontal level as said opening.

11. A gasifier according to claim 9, wherein said slag tap outlet is formed in a structure having a recess in which said burner means is mounted such that a portion of said structure surrounding said opening is surrounded by said burner means.

12. A gasifier according to claim 9, wherein said burner means comprises first and second substantially concentric annular passages each having a wall formed with outlet ports, the outlet ports in said wall of the said first passage being for allowing passage of fluid fuel from said first passage to said quenching chamber, and the outlet ports in said wall of said second passage being for allowing passage of combustion sustaining gas from said second passage to said quenching chamber.

13. A gasifier according to claim 12, wherein said second passage surrounds said first passage.

14. A gasifier according to claim 12, wherein at least some of said outlet ports are inclined downwardly from the respective first or second passage into said quenching chamber and extend along axes which are at acute angles to substantially a vertical axis at points on the vertical axis below a burner means.

15. A gasifier according to claim 14, wherein at least one of said acute angles is substantially 75°.

* * * * *